US006092244A

United States Patent [19]

Rizzardi et al.

[11] Patent Number: 6,092,244

[45] Date of Patent: Jul. 25, 2000

[54] LOCKING GRATE DEVICE FOR A FLOOR SINK

[75] Inventors: William D. Rizzardi, St. James; Guido Greco, Northport, both of N.Y.

[73] Assignee: Perlucid Corporation, Nesconset, N.Y.

[21] Appl. No.: 09/316,791

[22] Filed: May 21, 1999

[51] Int. Cl.[7] ..... E03C 1/26

[52] U.S. Cl. ..... 4/286; 4/290; 4/292; 4/293; 4/DIG. 14; 4/287; 285/191; 210/163; 210/164; 138/89; 138/96 R

[58] Field of Search ..... 4/286, 287, 289, 4/290, 291, 292, 293, 295, DIG. 14, 613, 682–693, 650, 653; 210/163, 164, 165, 166; 285/185, 191, 308, 309, 310, 412; 138/89, 96 R

[56] References Cited

U.S. PATENT DOCUMENTS

| | | | |
|---|---|---|---|
| Re. 26,366 | 4/1968 | Flegel . | |
| Re. 31,561 | 4/1984 | Thompson . | |
| Re. 33,439 | 11/1990 | Thomann et al. . | |
| 854,986 | 5/1907 | De Weese . | |
| 929,727 | 8/1909 | Sullivan . | |
| 969,776 | 9/1910 | Foley . | |
| 1,213,668 | 1/1917 | McKinstry . | |
| 1,310,055 | 7/1919 | Caldwell . | |
| 1,494,882 | 5/1924 | Barger . | |
| 1,618,679 | 2/1927 | Schifter | 4/292 |
| 1,653,403 | 12/1927 | McCue . | |
| 1,746,683 | 2/1930 | Schifter | 4/292 |
| 2,003,770 | 6/1935 | Goodhart . | |
| 2,800,231 | 7/1957 | Hicks | 4/292 |
| 3,037,631 | 6/1962 | Drehmann . | |
| 3,265,030 | 8/1966 | Stevens | 285/191 |
| 3,774,765 | 11/1973 | Kane et al. . | |
| 4,142,329 | 3/1979 | Williams . | |
| 5,069,781 | 12/1991 | Wilkes . | |
| 5,437,516 | 8/1995 | Sauerwein et al. . | |

*Primary Examiner*—Khoa Huynh
*Attorney, Agent, or Firm*—Galgano & Burke

[57] ABSTRACT

A locking grate for a floor sink includes a screen member having holes dimensioned to allow the passage of liquid but prevent the passage of solid waste and a mounting hole, a threaded member dimensioned to extend through the mounting hole, and a locking member which is adapted to be engaged by the threaded member. According to a presently preferred embodiment, the threaded member is a screw having a non-standard or atypical head which requires a non-standard or unusual screw driver. The locking member includes a tube which is orthogonally engaged by the screw and which has at least one rod slideably disposed therein. The tube and the rod are arranged such that when the screw engages the tube, the screw forces the rod to slide partially out of the tube. The end of the rod which extends out of the tube is preferably provided with a surface which frictionally engages the inner wall of the floor sink drain pipe. According to a presently preferred embodiment, the locking member includes a tube with two rods slideably disposed therein and an orthogonal hole located between the rods for receiving the screw. When the screw enters the orthogonal hole, it urges the two rods away from each other and partially out of the tube to engage the side wall of the floor sink drain pipe. Either the tube, the rods, or both include a thread engaging portion for engaging the threads of the screw.

14 Claims, 3 Drawing Sheets

LOCKING GRATE DEVICE FOR A FLOOR SINK

BACKGROUND OF THE INVENTION

1. Field of the Invention

The invention relates to drainage systems which are flush mounted in the floor of a facility. More particularly, the invention relates to a grate device for preventing solid waste from entering the drainage system.

2. State of the Art

Floor sinks have been used for many years in a wide variety of facilities such as commercial kitchens and laundries where it is likely that liquid waste will be frequently spilled onto the floor. Floor sinks are typically located in depression in the floor and collect waste water under the action of gravity. Nevertheless, due to differences in the floor topography, sometimes it is necessary to direct the waste water toward the floor sink with the aid of a push broom for example.

In many applications, the liquid waste collected by floor sinks contains solid particles of food or other debris that is only temporarily suspended in the waste water. If such solid particles enter the floor sink a blockage of the floor sink, plumbing or sewer system can result. This blockage will result in the waste water being prevented from running through the sewer system and hence the waste water will back up and cause flooding of the adjacent floor with waste water which is not only unsanitary but can also result in physical damage to articles that might be located where they can come into contact with the backed up waste water.

To remove such backed up waste water it is usually necessary to pump the waste water out and then remove the blockage of food particles or the like. The removal of the blockage most likely will require the use of plumbing tools such as an elongated flexible member that can be rotated such as that commonly referred to as a "snake". In severe cases the floor may have to be taken up and the sewage lines dug up so that the blocked portion can be cleaned out or replaced. Such procedures are very time consuming and are very expensive.

With the foregoing in mind, various types of screens and grates have been used to prevent suspended solid particles from entering the floor sink. A typical floor sink drainage system includes a pipe terminating at the surface of the floor and extending some distance orthogonally thereto and a grate or strainer which is surface mounted over the pipe on the floor. In proper operation, solid waste will accumulate on top of the grate where it is periodically removed (using a broom and pan) by workers so that it may be properly disposed and so that liquid may continue to flow freely into the drain. Many of these grates are simply attached with one or more screws. Some are merely friction fit and both types are easily removable. It has been observed that some workers, in an effort to save time, intentionally remove the grate from the floor sink in order to allow solid waste to enter the drain.

SUMMARY OF THE INVENTION

It is therefore an object of the invention to provide a grate mechanism for a floor sink.

It is also an object of the invention to provide a grate mechanism for a floor sink which is not easily removed without special tools.

It is another object of the invention to provide a grate mechanism for a floor sink which is easy to install with a special tool.

It is still another object of the invention to provide a grate mechanism for a floor sink which is easy to remove with a special tool.

In accord with these objects which will be discussed in detail below, the locking grate of the present invention includes a screen member having a plurality of holes dimensioned to allow the passage of liquid but prevent the passage of solid waste and a mounting hole, a threaded member dimensioned to extend through the mounting hole, and a locking member which is adapted to be engaged by the threaded member. According to the presently preferred embodiment, the threaded member is a screw having a non-standard or atypical head which requires a non-standard or unusual screw driver. The locking member preferably includes a tube which is orthogonally engaged by the screw and which has at least one rod slideably disposed therein. The tube and the rod are arranged such that when the screw engages the tube, the screw forces the rod to slide partially out of the tube. The end of the rod which extends out of the tube is preferably provided with a surface which frictionally engages the inner wall of the floor sink drain pipe. According to a presently preferred embodiment, the locking member includes a tube with two rods slideably disposed therein and an orthogonal hole located between the rods for receiving the screw. When the screw enters the orthogonal hole, it urges the two rods away from each other and partially out of the tube to engage the side wall of the floor sink drain pipe. Either the tube, the rods, or both include a thread engaging portion for engaging the threads of the screw. According to an exemplary embodiment, the tube is provided with a central orthogonal through hole and a threaded nut is welded to the tube adjacent to the orthogonal hole. According to the exemplary embodiment, the rods have pointed ends to engage the inner wall of the floor sink drain pipe and tapered ends for being engaged by the screw.

According to one embodiment, the screen member is circular with a central hole for the screw. The plurality of holes for draining are formed by making radial cuts in the screen member and bending down tongues to open the holes. According to this embodiment, at least one pair of depending tongues are arranged so that the locking member passes between them. This prevents the screen member from being rotated more than a few degrees and prevents the locking member from rotating while the screw is being tightened.

According to another embodiment, the screen member is rectangular and the locking member includes two orthogonal tubes or a + shaped tube and four sliding rods.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
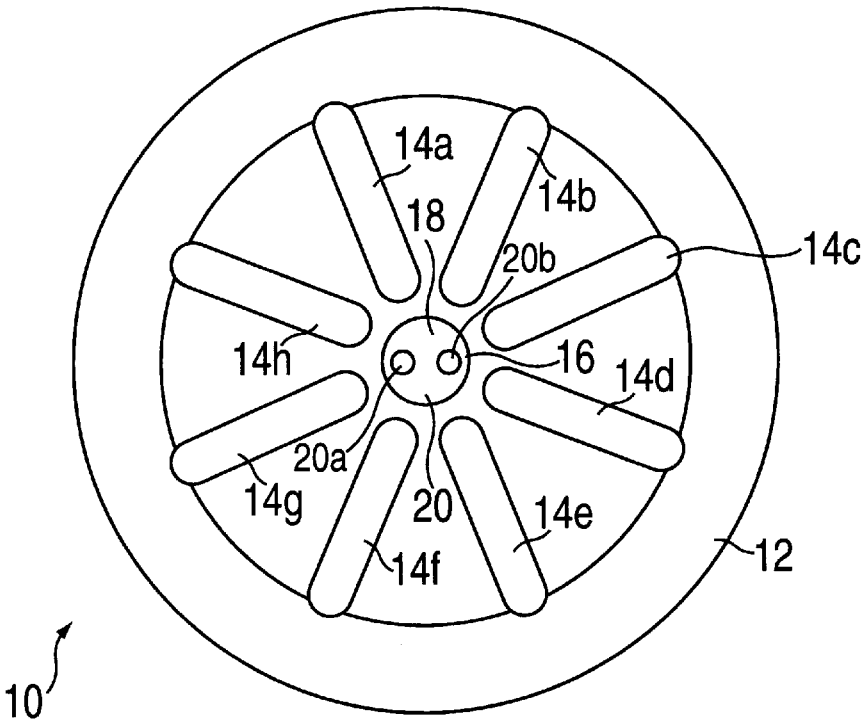
FIG. 1 is a top plan view of a first embodiment of the invention.
Figure 2:
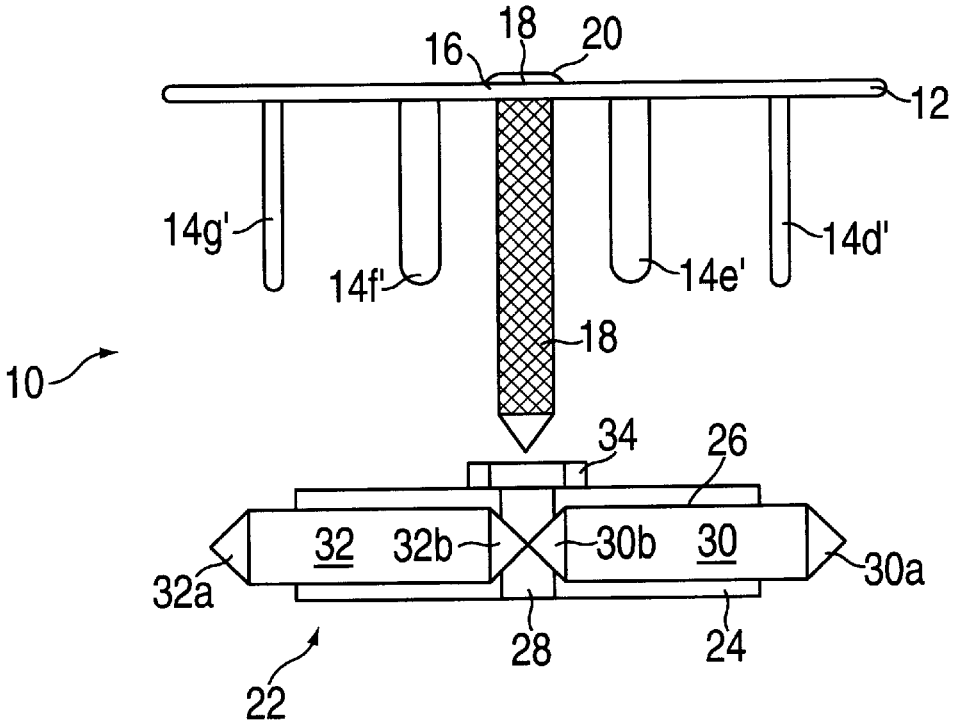
FIG. 2 is a partially transparent side elevation view of the first embodiment with the locking member not attached.
Figure 3:
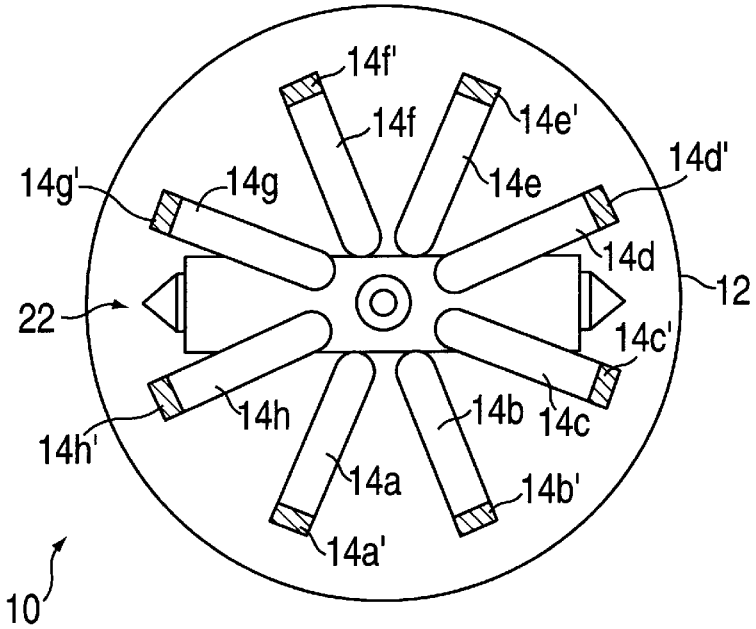
FIG. 3 is a bottom plan view of the first embodiment.

Referring now to FIGS. 1 through 3, a first embodiment of a locking grate 10 includes a circular screen member 12 having a plurality of holes 14*a*–14*h* which are dimensioned to allow the passage of liquid but prevent the passage of solid waste and a central mounting hole 16, a threaded member 18 dimensioned to extend through the mounting hole 16 having a non-standard or unusual head 20, and a locking member 22 which is adapted to be engaged by the threaded member 18. According to this embodiment, the holes 14*a*–14*h* are formed by making radial cuts in the screen member 12 and bending down tongues 14*a*'–14*h*' as seen best in FIGS. 2 and 3. In this embodiment, the head 20 of the threaded member 18 has two holes 20*a*, 20*b* for engagement with a special type of screw driver.

In this embodiment, the locking member 22 includes a tube 24 having an axial throughbore 26 and a central diametrical bore 28. Two sliding rods 30, 32 are disposed inside the bore 26 on opposite sides of the bore 28. The rods have pointed ends 30*a*, 32*a* which extend out of the tube 24 and tapered ends 30*b*, 32*b* which extend into the bore 28. A threaded nut 34 is preferably welded to the tube 24 adjacent to the bore 28.

Figure 4:
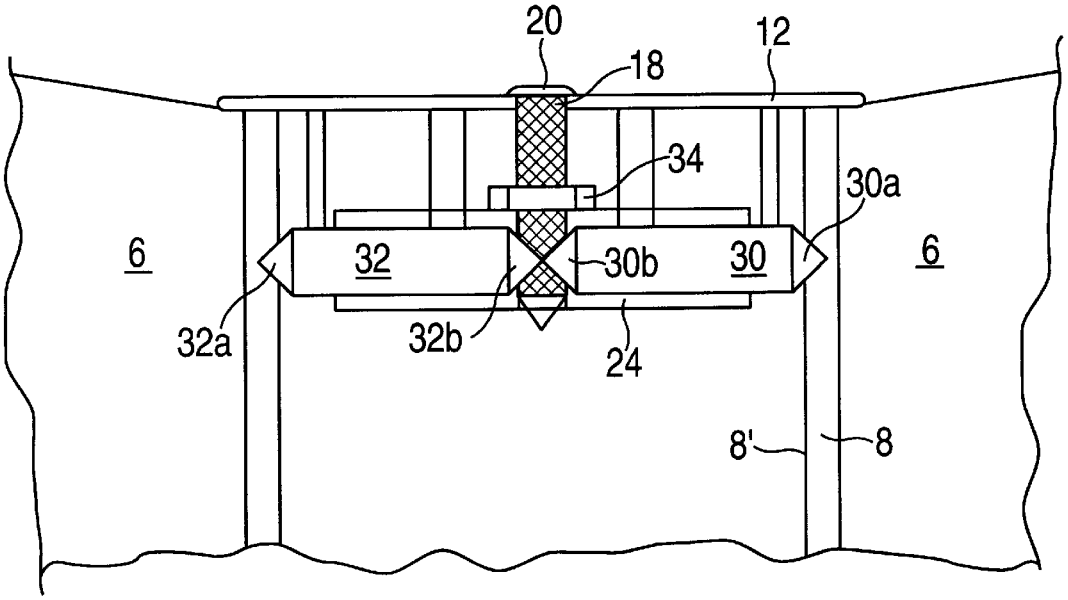
FIG. 4 is a partially transparent side elevation view of the first embodiment installed in a floor sink drain pipe.

Turning now to FIG. 4, the locking grate 10 is preferably installed in a drain pipe 8 located in the floor 6 of a floor sink which is located below another grate which is flush with the floor. Prior to installing the grate, the locking member 22 is attached to the threaded member 18 so that the nut 34 is engaged by the threaded member but the tapered ends 30*b*, 32*b* of the rods 30, 32 are not sufficiently engaged to push the rods very far out of the tube 24. The assembly is then lowered into the pipe 8 so that the screen 12 lies flush over the end of the pipe. The screw 18 is turned with the aid of a special driver (not shown) which is designed to engage the unusual or non-standard head 20. As the screw 18 enters the tube 24, the screw engages the tapered ends 30*b*, 32*b* of the rods 30, 32 and causes the rods to slide partially out of the tube such that the pointed ends 30*a*, 32*a* of the rods engage the inner wall 8' of the drain pipe 8.

Figure 5:
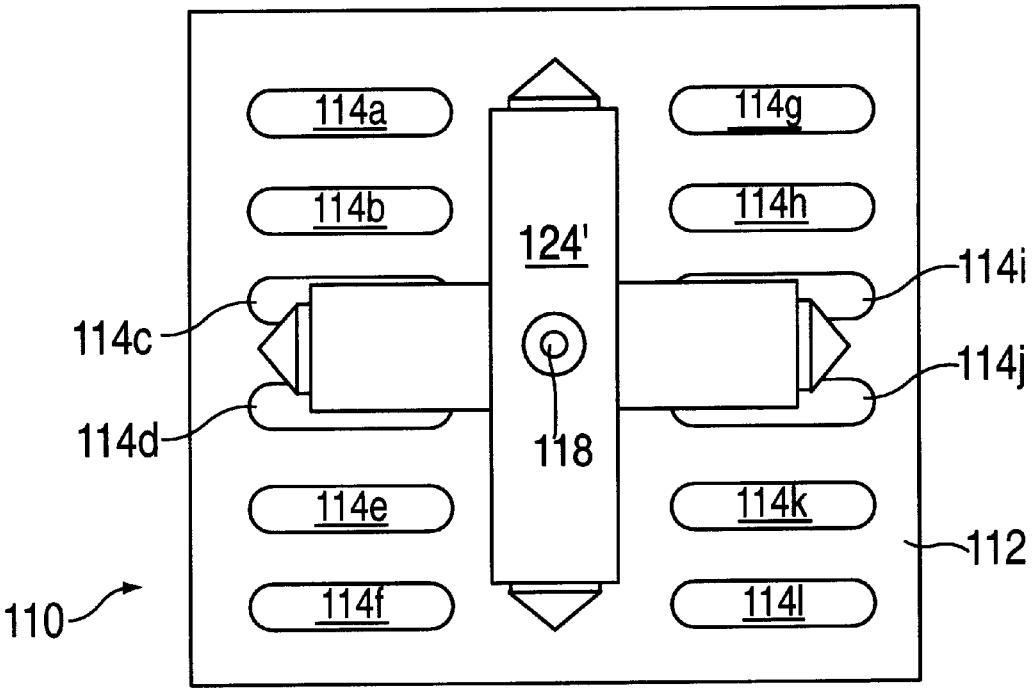
FIG. 5 is a bottom plan view of a second embodiment of the invention.

Referring now to FIG. 5, a second embodiment of a locking grate 110 has a rectangular screen member 112 with a plurality of holes 114*a*–114L which are dimensioned to allow fluid to pass through but to block the passage of solid waste. The screen member 12 also has a central mounting hole (not shown). The locking grate assembly 110 includes a screw 118 substantially the same as the screw 18 described above and includes two orthogonal tubes 124, 124', each of which is substantially the same as the tube 24 described above and each of which includes rods as described above. The tubes 124, 124' are secured in orthogonal relationship to each other by welding. Alternatively, a single + shaped tube member may be used. This embodiment functions substantially the same as the first embodiment but is designed to cover a rectangular drain or fit into a pipe having a rectangular cross section.

As can be readily appreciated, the locking grate of the present invention is readily adaptable to existing drain pipes of various diamiters and, in addition, does not require any special fittings or receptacles to enable its installation and/or locking function.

There have been described and illustrated herein several embodiments of a locking grate for a floor sink. While particular embodiments of the invention have been described, it is not intended that the invention be limited thereto, as it is intended that the invention be as broad in scope as the art will allow and that the specification be read likewise. Thus, while particular screen shapes have been disclosed, it will be appreciated that other screen shapes (e.g. hexagonal, octagonal, etc.) could be utilized. Also, while a particular tube and sliding rod assembly have been shown, it will be recognized that other types of tubes with sliding rods could be used with similar results obtained. For example, the tubes and rods need not have circular cross sections. The pipe engaging end of the rod(s) need not be conical as shown, but may have any type of frictional surface such as saw tooth for example. Moreover, while particular configurations have been disclosed in reference to the threaded member, it will be appreciated that other configurations could be used as well. For example the threaded member may be more tapered and the tapered ends of the rods thus less tapered or not tapered at all. Furthermore, while the second embodiment has been disclosed as having a pair of tubes with rods, it will be understood that a single tube with rods can achieve the same or similar function so long as one or more tongues or other structure is provided to prevent the tube from rotating while the screw is being tightened. It will therefore be appreciated by those skilled in the art that yet other modifications could be made to the provided invention without deviating from its spirit and scope as so claimed.

What is claimed is:

1. A locking grate for a floor sink having a drain pipe, comprising:

a) a screen member having a plurality of holes dimensioned to allow the passage of liquid but prevent the passage of solid waste and a mounting hole;

b) a threaded member dimensioned to extend partially through said mounting hole and having a head portion which prevents it from passing through said mounting hole;

c) a locking member which is adapted to be engaged by said threaded member, said locking member having engaging means for frictionally engaging the inner wall of the drain pipe in response to said locking member being engaged by said threaded member; and said locking member includes a tube which is orthogonally engaged by said threaded member and which has at least one rod slidably disposed therein.

2. A locking grate according to claim 1, wherein:

said head portion is adapted to be engaged by one of a non-standard screw driver or an unusual screw driver.

3. A locking grate according to claim 1, wherein:

said tube and said rod are arranged such that when said threaded member engages said tube, said rod is forced to slide partially out of said tube.

4. A locking grate according to claim 1, wherein:

said rod has an end provided with a surface which frictionally engages the inner wall of the drain pipe.

5. A locking grate according to claim 1, wherein:

said locking member includes a tube with two rods slideably disposed therein and an orthogonal hole located between said rods for receiving said threaded member, such that when said threaded member enters said orthogonal hole, it urges said two rods away from each other and partially out of said tube to engage the side wall of the drain pipe.

6. A locking grate according to claim 5, wherein:

said tube has a thread engaging portion for engaging the threads of said threaded member.

7. A locking grate according to claim 6, wherein:

said thread engaging portion is a threaded nut welded to said tube adjacent to said orthogonal hole.

8. A locking grate according to claim 5, wherein:

each of said rods has and end provided with a surface which frictionally engages the inner wall of the drain pipe.

9. A locking grate according to claim 5, wherein:

each of said rods has a pointed end which frictionally engages the inner wall of the drain pipe.

10. A locking grate according to claim 8, wherein:

each of said rods has a tapered end which is engaged by said threaded member.

11. A locking grate according to claim 1, wherein:

said screen member is circular and said mounting hole is centrally located.

12. A locking grate according to claim 1, wherein:

said plurality of holes are formed by making radial cuts in said screen member and bending down tongues to open the holes.

13. A locking grate member according to claim 12, wherein:

at least one pair of said tongues are arranged so that said locking member passes between them.

14. A locking grate according to claim 1, wherein:

said screen member is rectangular and said mounting hole is centrally located.

* * * * *